US010400397B2

(12) United States Patent
Click et al.

(10) Patent No.: US 10,400,397 B2
(45) Date of Patent: Sep. 3, 2019

(54) BOLTLESS RAIL BRACE

(71) Applicant: voestalpine Nortrak Inc., Cheyenne, WY (US)

(72) Inventors: Gary Click, Birmingham, AL (US); Brent Duffner, Pinson, AL (US); Bradley Smith, Pell City, AL (US); Derek Cameron, Birmingham, AL (US)

(73) Assignee: voestalpine Nortrak Inc., Cheyenne, WY (US)

( * ) Notice: Subject to any disclaimer, the term of this patent is extended or adjusted under 35 U.S.C. 154(b) by 354 days.

(21) Appl. No.: 15/476,883

(22) Filed: Mar. 31, 2017

(65) Prior Publication Data

US 2018/0282949 A1 Oct. 4, 2018

(51) Int. Cl.
*E01B 9/60* (2006.01)
*E01B 9/62* (2006.01)

(52) U.S. Cl.
CPC ..... *E01B 9/60* (2013.01); *E01B 9/62* (2013.01); *E01B 2201/02* (2013.01)

(58) Field of Classification Search
CPC ..... E01B 2201/02; E01B 9/60; E01B 9/62; E01B 9/66; E01B 9/68; E01B 9/34; E01B 9/483; E01B 9/685
USPC ..... 238/336, 337, 292, 310, 315, 333, 354, 238/361; 254/104
See application file for complete search history.

(56) References Cited

U.S. PATENT DOCUMENTS

| | | | | | |
|---|---|---|---|---|---|
| 804,618 | A * | 11/1905 | Newton | E01B 5/18 | 238/17 |
| 1,872,848 | A * | 8/1932 | Told | E01B 9/66 | 238/336 |
| 2,101,313 | A | 4/1935 | Gillespie | | |
| 2,515,678 | A * | 7/1950 | Vickroy | E01B 9/60 | 238/292 |
| 4,119,271 | A | 10/1978 | Campbell | | |
| 4,566,630 | A | 1/1986 | Keiper, Jr. | | |
| 4,770,342 | A | 9/1988 | Farrell et al. | | |
| 4,824,015 | A | 4/1989 | Farrell et al. | | |
| 6,079,631 | A * | 6/2000 | Ortwein | E01B 9/60 | 238/283 |
| 6,308,897 | B1 | 10/2001 | Remington et al. | | |
| 6,517,008 | B1 | 2/2003 | Remington et al. | | |
| 6,568,601 | B2 * | 5/2003 | Maynard | E01B 9/50 | 238/292 |
| 6,758,406 | B2 | 7/2004 | Weaver | | |
| 6,971,610 | B2 | 12/2005 | Hein | | |
| 7,641,128 | B2 | 1/2010 | Remington et al. | | |
| 8,313,041 | B2 | 11/2012 | Remington et al. | | |
| 2018/0016753 | A1 * | 1/2018 | Dixon | E01B 11/10 | |

* cited by examiner

*Primary Examiner* — Mark T Le
(74) *Attorney, Agent, or Firm* — Lowe Graham Jones PLLC

(57) ABSTRACT

A boltless brace assembly for a rail includes a base block interlocked with a brace, and further includes a wedge to be inserted between an upper surface of the base block and a lower surface of the brace, thereby applying an upward force to the brace and a resultant downward force to secure the rail base. The brace assembly may be modified to provide a universal brace assembly, a resilient brace assembly, or a frog base clamp.

26 Claims, 12 Drawing Sheets

BOLTLESS RAIL BRACE

FIELD OF THE INVENTION

This invention relates to boltless brace assemblies, specifically designed for switches, curves and similar areas where only one side of the rail is braced against rollover and lateral movement. In particular, this invention relates to a boltless rail brace assembly having a wedge to secure the brace against the rail.

BACKGROUND OF THE INVENTION

A rail brace is used to stabilize and support a rail, preventing it from rolling over due to lateral loads applied to the rail head by passing trains. In applications such as switches, curves and similar areas where only one side of the rail is braced, it is crucial to provide a sufficiently strong and resilient rail brace to oppose the rollover and lateral forces applied by passing trains. However, it is also economically important to minimize the time and manpower required to install and maintain brace assemblies. Bolted brace assemblies, where the brace is bolted through the tie plate, are more costly and difficult to manufacture, install and maintain. Boltless versions, wherein the brace is retained by an inelastic or elastic fastener, may therefore be preferred.

U.S. Pat. No. 2,101,313 to Gillespie discloses a rail brace assembly having a brace mounted on the rail plate to support the toe of a spring wedge, pressing the wedge against the web and down onto the base of the rail. A pawl in the brace engages with the spring wedge to force the wedge laterally against the rail and to lock the wedge in place against the rail. The spring wedge is made of two pieces with their ends welded together but otherwise having a gap between them to provide shock absorption and resilience when the load of a passing train is applied.

U.S. Pat. No. 4,119,271 to Campbell discloses a rail brace that relies solely on an elongated elastic fastener to both hold down the rail base and to provide lateral support by extending to abut the underside of the rail head. Due to the shape and material from which the brace is made, the brace provides a certain degree of resilience under lateral forces.

U.S. Pat. No. 4,566,630 to Keiper, Jr. discloses a boltless, friction fit adjustable brace that includes a brace wedged against the rail between the lower side of the rail head and having a toe that extends over and past the upper side of the rail foot. A washer is held down over the brace toe by a spring clip supported on a stop block (also called a brace block or wedge block). The dimensions of the brace are tapered, allowing the brace to be tightly wedged between the rail and the stop block. Rollover and lateral forces from passing trains are resisted by the abutment of the brace and the stop block, and downward force of the spring clip on the toe of the brace.

U.S. Pat. No. 4,824,015 to Farrell et al. discloses a similar system, in which the washer is omitted and the spring clip appears to bear directly on an upper surface of the toe of a rail brace. Extending legs on the brace toe surround the spring clip retainer, ensuring that the brace does not move along the length of the rail. U.S. Pat. No. 5,104,041 to Remington discloses a similar arrangement, with the addition of a bearing insert between the brace toe and the toe of the spring clip, which seems to fulfill a similar function as a washer.

U.S. Pat. No. 4,770,342 to Farrell et al. discloses a rail brace system wherein the washer is replaced by an L-shaped cover plate, similar to the bearing insert of Remington but larger, inserted between the brace toe and the wedge block. Serrated surfaces and wedge-shaped faces ensure a very secure fit between the brace and the wedge block. However the spring clip exerts a downward force on the distal side of the cover block from the brace toe, rather than applying downward force directly over the toe. While the large cover plate may provide a very snug wedge between the brace toe and the wedge block, the downward force is quite removed from the brace and therefore might not provide sufficient force to restrain the rail.

U.S. Pat. No. 6,758,406 to Weaver discloses a rail brace assembly having a brace wedged against the rail between the lower side of the rail head and the upper side of the rail foot. The lower front surface of the brace includes a tongue, which interlocks with a groove in the wedge block. The brace tongue is angled, so it can be wedged between the rail and the wedge block to secure it along the rail web. The brace has an approximately central shoulder having a serrated upward-facing surface. A fastener plate sits on the serrated surface of the brace shoulder and is held down by a spring clip, which applies a downward force to the fastener plate and to the brace shoulder to hold the brace in position. Weaver's system may be more stable than that disclosed by Keiper, in that the downward force applied to the brace is somewhat more centralized and applied more into the body of the brace and the rail, and the interlocking of the brace and the wedge block may provide more stability than a simple abutment.

U.S. Pat. Nos. 8,313,041, 7,641,128, 6,308,897 and 6,517,008 to Remington et al. and U.S. Pat. No. 6,971,610 to Hein each similarly disclose brace assemblies wherein the clip retainer is positioned to allow the spring clip to exert force on the central part of the brace. The assemblies also comprise the toe of the brace, or a wedging piece positioned at the toe of the brace, interlocking with the stop block.

The primary lateral force applied by these brace assemblies is supplied by the tapered faces of the brace and wedge blocks to force the brace against the rail web, the underside of the rail head and the top of the rail base. Additionally, each brace assembly applies a downward clamping force, provided by the toe of the spring clip and/or a wedge near the brace toe. However, in each case, the locking of the brace to the rail is controlled and applied solely by the force of the spring clip. During installation, if the applied loads exceed the toe load of the clip, the clip may not hold. The brace will then loosen, allowing the tie assembly to fall off.

In order to overcome this potential problem, brace assemblies have been developed that avoid the need for a spring clip entirely. For example, U.S. Pat. No. 6,568,601 to Maynard discloses a rail brace assembly where the brace is held by a wedge tightly fitted between the brace toe and a stop block. A second downward vertical force is supplied by the interaction of a set of ribs underneath the brace with a block welded to the base plate. Again, the primary forces are applied directly to the brace and the brace toe. Further, construction and installation of the brace assembly may be complicated by the need to locate and weld the block to the base plate, as well as to ensure that the ribs of the brace are interlocked with the block.

It is therefore an object of the invention to provide a rail brace assembly that addresses the foregoing deficiencies.

It is a further object of the invention to provide a rail brace assembly that clamps the brace mechanically using a wedge to maintain a constant load on the brace itself.

It is a further object of the invention to provide a brace assembly that is universal, able to be used with almost any rail section.

It is yet a further object of the invention to provide a brace assembly that comprises a resilient aspect, in order to better manage lateral loads applied by the wheels of passing trains.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY OF THE INVENTION

The brace assembly of the invention comprises a brace, positionable on the base or foot of a rail, which interlocks with a base block placed a distance away from the rail. A wedge slides between an upper surface of the base block and an underside of the brace, applying an upward force on the brace. The upward force is translated into a rotational force around the interlock between the brace and base block and results in a downward force being applied to the rail base to hold it in place. The wedge maintains a constant clamping load on the brace. An optional spring clip may be used to exert force on the wedge or on an optional washer and maintain the adjustment of the brace, but the spring clip does not bear directly down on the brace.

In another embodiment, the upper portion of the brace may be removed, providing a more universal brace configuration that can be used with different rail cross-sections. The upward force applied to the nose of the brace results in a downward load on the rail base, rather than a force into the side of the rail web. The portion of the brace that would otherwise sit against the side of the rail web can therefore be removed without substantially affecting the load applied to secure the rail. The brace assembly can therefore be applied to any rail section, without concerns over whether the brace fits snugly between the rail head and base.

In another embodiment, the upper portion of the brace may be moveable relative to the bottom portion, and provided with a spring element on or near the upper portion, thereby establishing a degree of resilience in the brace to assist with managing the lateral loads applied by passing trains.

In yet another embodiment, the brace shape may be altered, allowing the same principles to be applied for use as a frog clamping brace.

In one aspect, the invention comprises an assembly to brace a rail, comprising a brace; a base block interlocked with the brace; and a wedge insertable between an upper surface of the base block and an under surface of the brace. The wedge is preferably tapered through its thickness, along its length.

In a further aspect, the assembly may comprise a shoulder on the brace block to accommodate an elastic fastener. A locking washer placeable over the wedge which is interlocked with the brace may be retained by the elastic fastener provided. The washer may comprise a pair of legs that extend beside the shoulder.

In yet a further aspect, the rail brace assembly may comprise a groove in a front side of the brace and a tongue on a rear side of the brace block, wherein meshing of the groove and the tongue cause the base block and the brace to interlock.

In another aspect, the rail brace assembly may comprise a brace that does not extend to the underside of the head of the rail.

In yet another aspect, the rail brace assembly may further comprise a resilient element. The resilient element may be located at a suitable position, such as between the brace and the rail, or on or under the wedge, between the wedge and the brace or the base block.

In another aspect, the rail brace assembly may comprise a brace having a top portion that is articulated. The assembly may also comprise a resilient element between the top portion of the brace and the rail.

The foregoing may cover only some of the aspects of the invention. Other aspects of the invention may be appreciated by reference to the following description of at least one preferred mode for carrying out the invention in terms of one or more examples. The following mode(s) for carrying out the invention is not a definition of the invention itself, but is only an example that embodies the inventive features of the invention.

BRIEF DESCRIPTION OF THE DRAWINGS

At least one mode for carrying out the invention in terms of one or more examples will be described by reference to the drawings thereof in which.

DETAILED DESCRIPTION OF AT LEAST ONE MODE FOR CARRYING OUT THE INVENTION IN TERMS OF EXAMPLE(S)

Figure 1A:
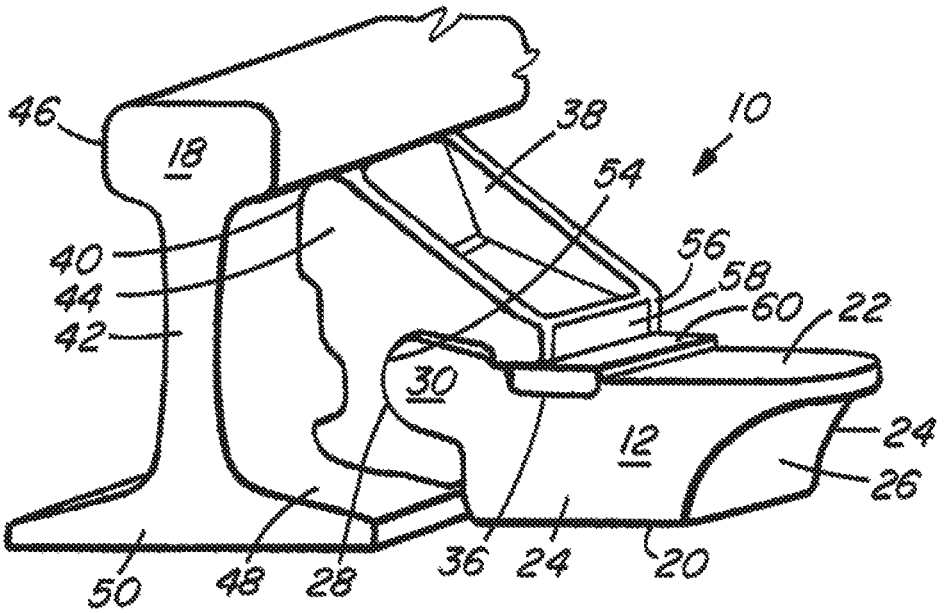
FIG. 1*a* is a perspective view of a first embodiment of the rail brace assembly of the invention.
Figure 1B:
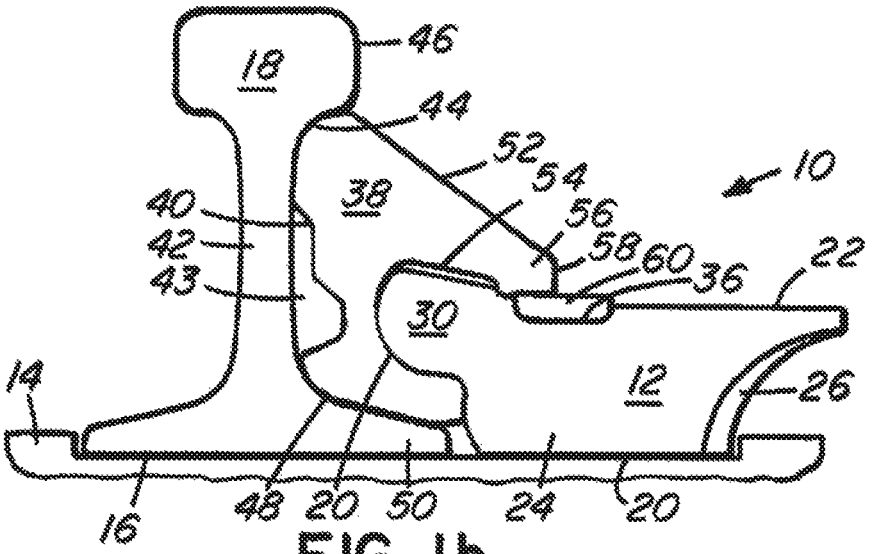
FIG. 1*b* is a side view of the rail brace assembly of FIG. 1*a;*
Figure 2:
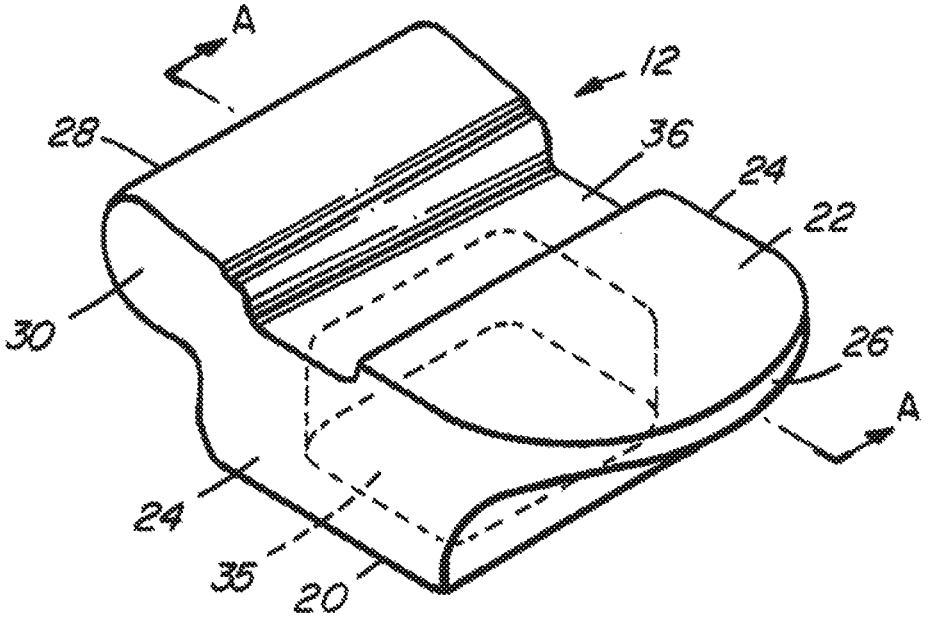
FIG. 2 is a perspective view of a base block of the rail brace assembly of FIG. 1.
Figure 3:
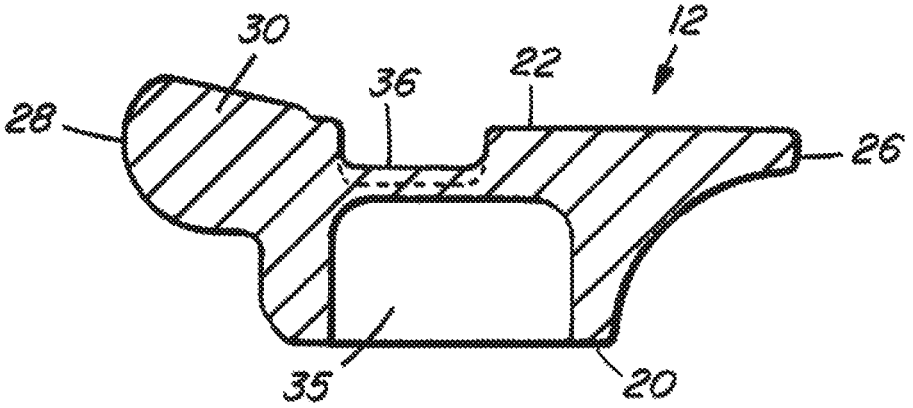
FIG. 3 is a sectional view of the base block of FIG. 2, taken along line A-A.
Figure 4:
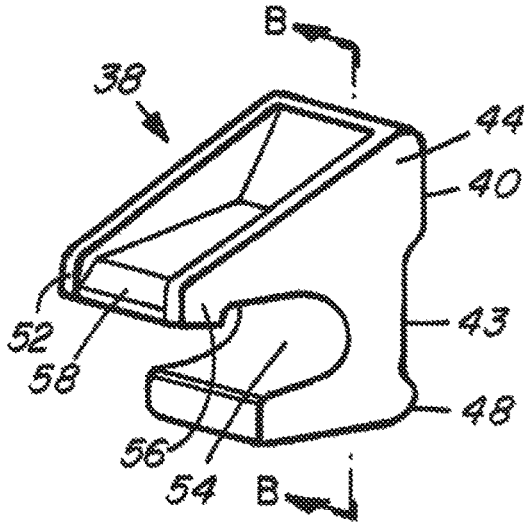
FIG. 4 is a perspective view of a brace of the rail brace assembly of FIG. 1.
Figure 5:
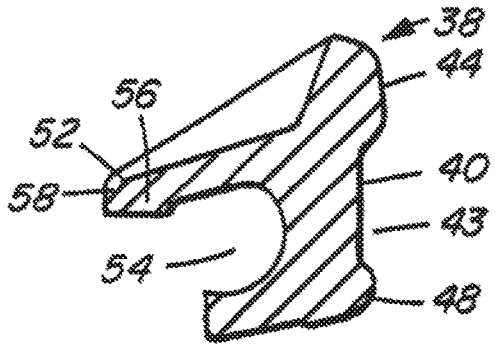
FIG. 5 is a sectional view of the brace of FIG. 4, taken along line B-B.
Figure 6:
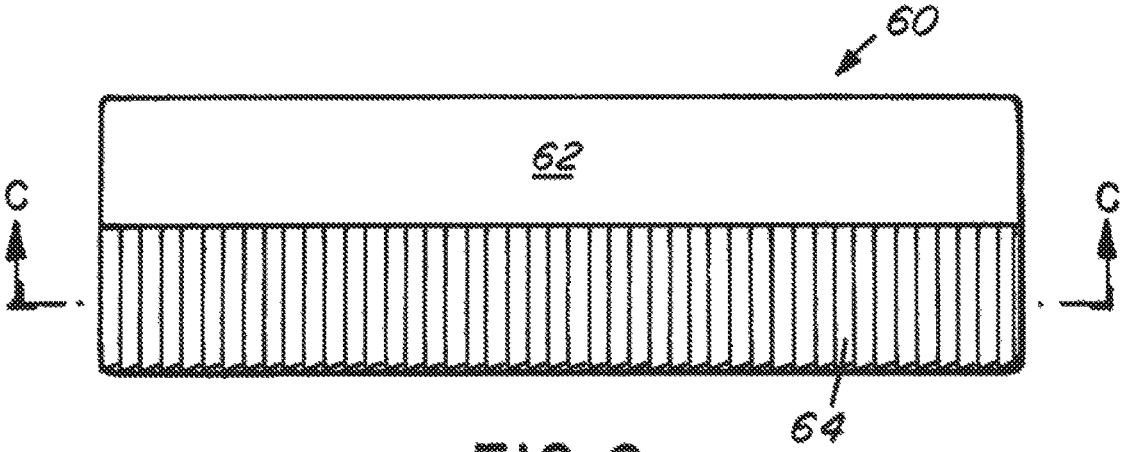
FIG. 6 is a top view of a wedge of the rail brace assembly of FIG. 1.
Figure 8A:
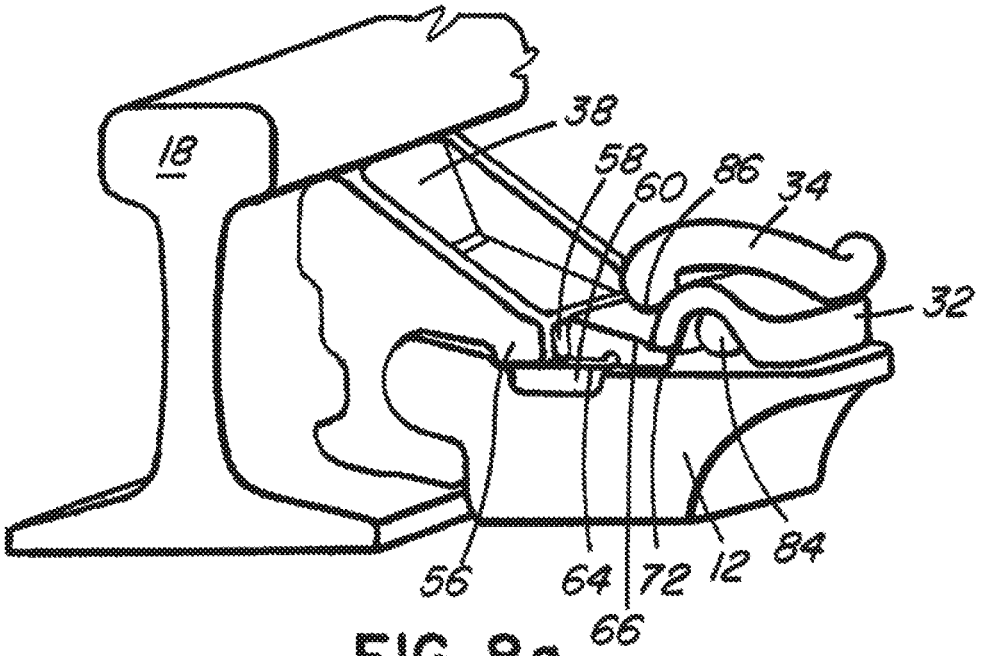
FIGS. 8*a* and 8*b* are perspective and side views, respectively, of the rail brace assembly of FIG. 1 including an optional locking washer and spring clip.
Figure 8B:
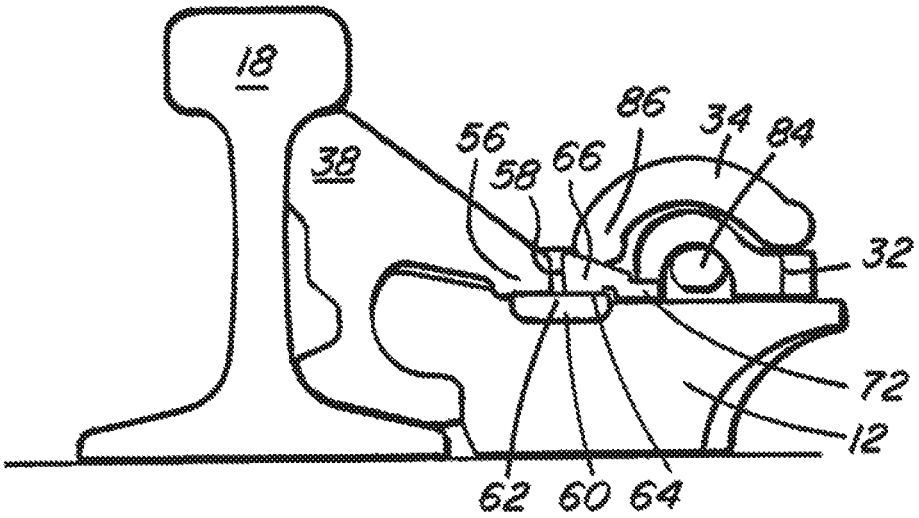
Figure 9:
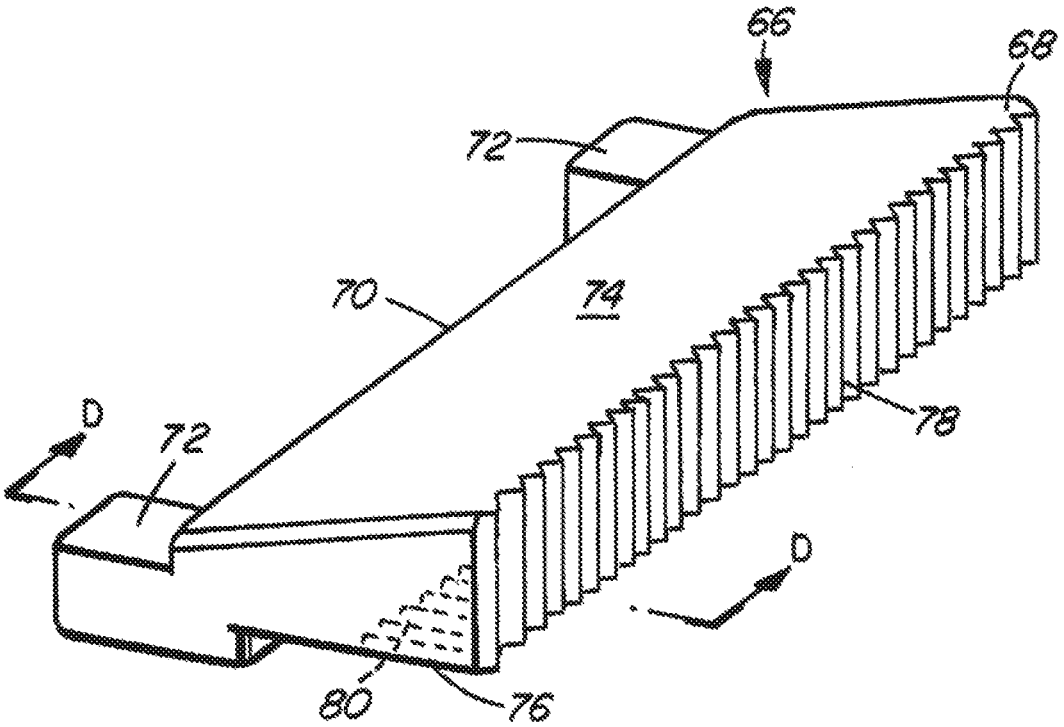
FIG. 9 is a perspective view of a locking washer for the rail brace assembly as shown in FIG. 8.
Figure 10:
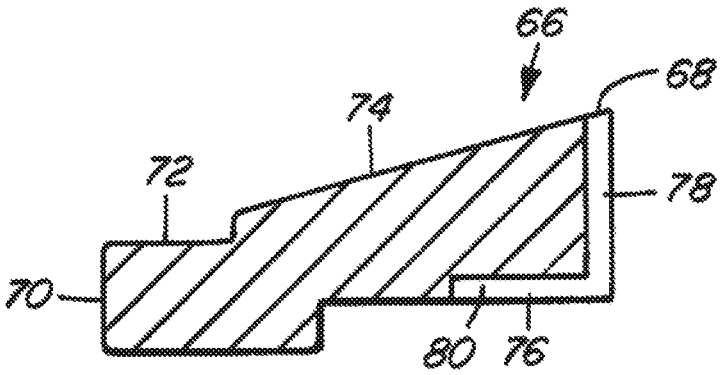
FIG. 10 is a sectional view of the locking washer of FIG. 9, taken along line D-D.

In a first embodiment, best shown in FIGS. 1*a*-7, the invention comprises a boltless rail brace assembly 10 including a base block 12 mounted on a tie plate 14, interlocking with a brace 38 and a wedge 60. The tie plate 14 comprises a rail seat 16 to accommodate the base of a rail 18. The base block 12 is essentially a rectangular block having bottom 20, top 22 and two side 24 surfaces, along with a rear surface 26, which faces away from the rail seat 16, and an opposed nose 28 that faces towards the rail seat 16. In the embodiment shown, the nose 28 includes a tongue 30 that extends towards the rail seat 16, when the base block 12 is in place on the tie plate 14. In some embodiments, such as that shown in FIGS. 8-10, a shoulder 32 to retain an elastic fastener, such as spring clip 34, may be fastened to the top surface 22 of the base block 12; however, the spring clip (and the shoulder to retain it) is not necessary for the rail brace assembly 10 to perform its rail bracing function and may be omitted. The top surface 22 also contains a channel 36, preferably running in a direction substantially parallel to the rail axis. The rear surface 26 may be curved, as best shown in FIGS. 2 and 3, or may be a vertical face or any other suitable configuration as required to accommodate and provide clearance for any installation hardware, such as clips, holding the plate down to the tie. The base block 12 may be a substantially solid block, or, as shown, may have one or more cavities 35 in its body to reduce the overall weight and cost of the base block 12.

The brace 38 comprises an angled vertical rear surface 40, which is shaped to substantially abut the web 42 of rail 18, although a space 43, may be left, for example to accommodate a rail heater. In the embodiment shown, the top 44 of the brace 38 is shaped to abut the underside of the rail head 46, while the bottom surface 48 of the brace 38 is shaped to rest on top of the rail base 50. The front side 52 of the brace 38, being the side that faces away from the rail seat 16, includes a groove 54, preferably running in a direction substantially parallel to the rail axis. Above the groove 54, a nose 56 extends away from the rail seat 16. The front edge 58 of the nose 56 is preferably at least partially serrated. It will be understood that a reverse interlocking configuration may be used; i.e. the nose 28 of base block 12 may be provided with a groove while the front side 52 of the brace 38 is provided with a tongue.

Figure 7:
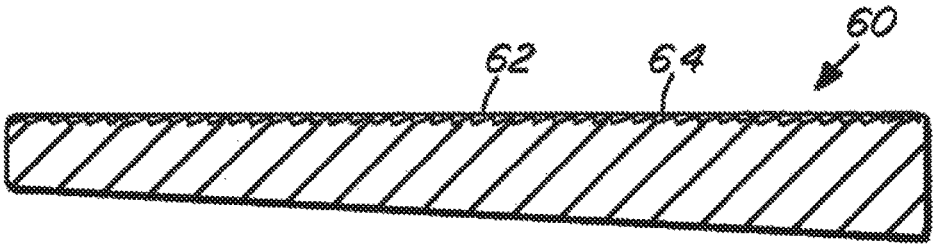
FIG. 7 is a sectional view of the wedge of FIG. 6, taken along line C-C.

The wedge 60 comprises an approximately rectangular piece, sized to fit snugly fit into the channel 36 in the top surface 22 of the base block 12 and underneath the nose 56 of the brace 38. The thickness of wedge 60 preferably tapers along its length, as best seen in FIG. 7, which may assist with insertion of the wedge between the base block 12 and the brace 38. The top surface 62 of the wedge 60 is preferably at least partially serrated 64, and may be relatively smooth otherwise.

In use, the brace 38 slides between the rail web 42 and the base block 12, so that the brace groove 54 interlocks with tongue 30 of the base block 12, while the bottom surface 48 of the brace 38 abuts the rail base 50. The nose 56 of the brace 38 extends towards and slightly over the channel 36. The wedge 60 slides into the channel 36, smooth side under the nose 56 of the brace 38, until the wedge 60 fits snugly with the brace nose 56. In this configuration, the essentially upward force applied by the wedge 60 to the underside of the nose 56 results in a rotational force in the brace 38 around the tongue 30 of the base block 12, thereby causing the rail brace assembly 10 to provide a downward force primarily on the rail base 50. This restraining force is applied to the rail, holding it in place, even without the need for an elastic fastener or other force applied to the exposed portion of the wedge 60. In contrast to the prior art references discussed earlier, the clamping force is not merely a downward force provided on the toe of a brace by the toe of the spring clip and/or a wedge near the brace toe, removed from the rail base 50. Instead, the force is applied quite near or directly to the rail base 50 and against rail web 42, making the entire brace assembly stronger and more secure, even without the additional force that may be provided by an elastic fastener. This transfer of an upward force applied by the wedge 60 on the underside of the brace 38 to a downward force on the bottom of the brace 38 and then to the rail base 50, occurs whether the interlock between the brace groove 54 and tongue 30 is rounded as shown, or is of another configuration, such as squared or otherwise angled. It follows that the shape of the interlock is preferably rounded, but may be otherwise.

Optionally, locking washer 66, which is an approximately U-shaped piece having a rear surface 68, an opposed front surface 70 with a pair of extending legs 72, and top 74 and bottom 76 surfaces, may be used with a spring clip 34 or similar elastic fastener to maintain the alignment of the rail brace assembly 10, as best shown in FIGS. 8*a*-10. The washer is preferably tapered from rear 68 to front 70. Rear surface 68 is preferably at least partially serrated 78; bottom surface 76 is likewise preferably at least partially serrated 80.

The locking washer 66 is placed on top of wedge 60 with the serrated underside 78 overlying serrated area 64 on wedge 60, while the rear serrated surface 78 meshes with the serrated front edge 58 of the nose 56. The interlocking of the serrated portions of the brace assembly 10 provide a friction fit between the brace 38, wedge 60 and locking washer 66. The legs 72 of the locking washer 66 sit on either side of shoulder 32, preventing movement of the washer in the direction substantially parallel to the rail axis.

The spring clip 34 may then be installed, with one leg 84 being retained by the shoulder 32 on the base block 12 and the toe 86 bearing on the exposed top surface of the locking washer 66. This downward pressure on the locking washer 66 provides a downward force on the exposed top surface 64 of the wedge 60, forcing the wedge 60, locking washer 66 and brace 38 more tightly together and providing additional support to the assembly 10. The spring clip bears directly on the locking washer 66, and then on to wedge 60. Alternatively, the locking washer 66 may be omitted and the spring clip 34 may bear directly on the top surface 62, which may be fully or partially serrated, or which may not be serrated, of the wedge 60. It does not bear directly on the brace 38, nor does it apply any generally downward force on the brace 38. The toe strength of the spring clip 34 is therefore not the limiting factor in determining the resistance of the rail brace assembly 10 to rollover or lateral forces.

Figure 11:
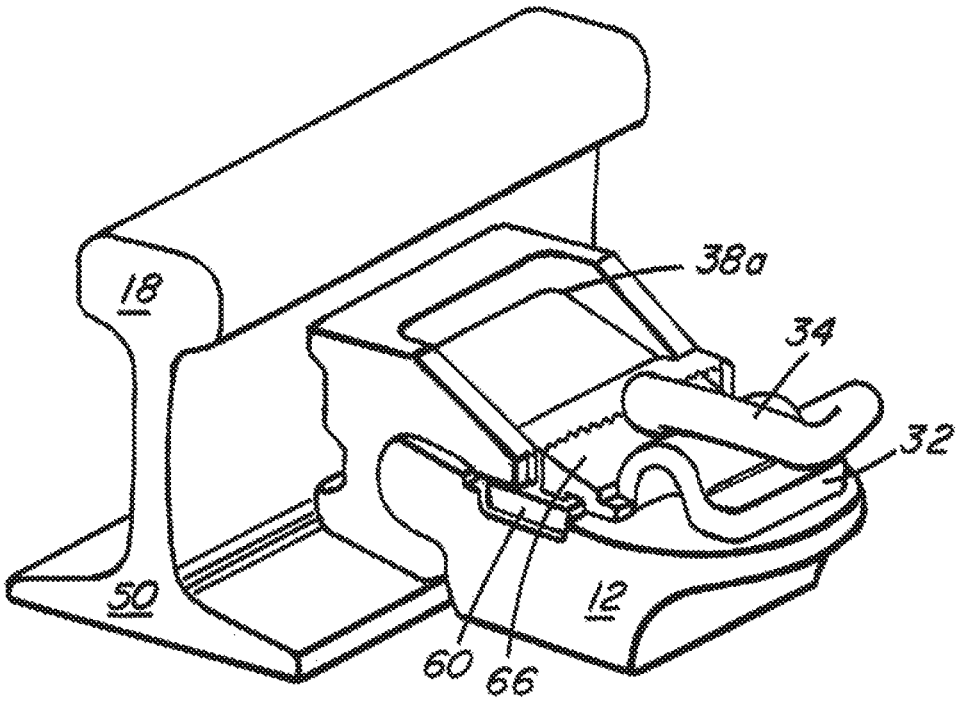
FIG. 11 is a perspective view of a second embodiment of the rail brace assembly of the invention.
Figure 12:
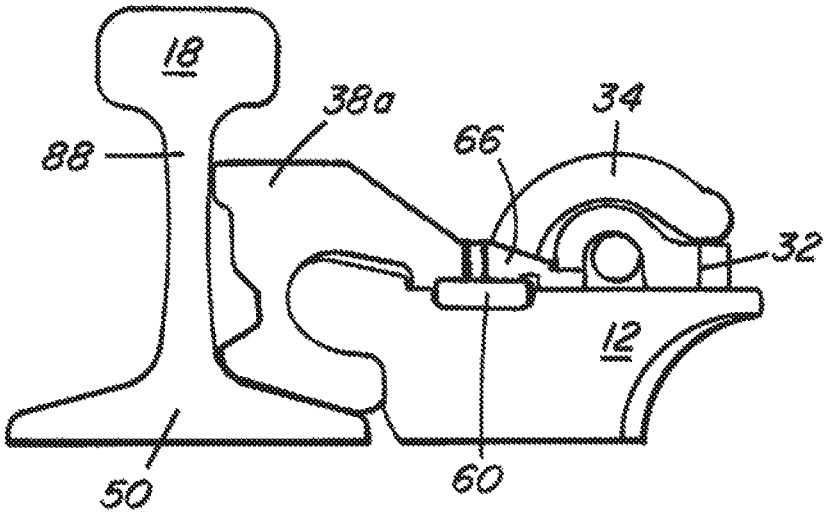
FIG. 12 is a side view of the rail brace assembly of FIG. 11.

It is also contemplated that the brace 38 may be provided in a more universal configuration. Typically, a brace must be designed with an appropriate size to specifically match the height of a rail section (115RE, 133RE, 136RE, etc.) where it is to be installed, in order to fit snugly and to allow the brace to properly wedge against the head and base of the rail. In the present invention, the brace is effectively clamped to the rail primarily at the rail base, via the pressure applied by the wedge through rotation of the brace about the tongue of the base block. Because the top of the brace does not exert any real force directly on the rail head, an embodiment of brace 38*a* could be provided wherein some or most of the brace 38*a* could substantially be eliminated above about the centerline 88 of the rail web, as best shown in FIGS. 11 and 12. This configuration would be applicable to several different, if not all, rail sections, making it possible to install the same brace assembly at any point in a track without the need to worry whether the brace matches the profile of the rail section.

Figure 13:
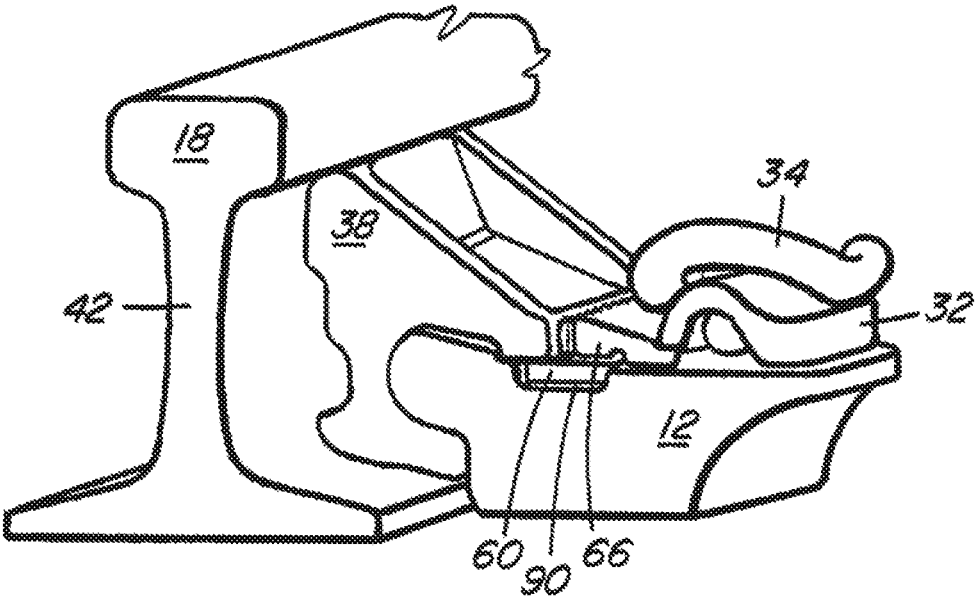
FIG. 13 is a perspective view of a third embodiment of the rail brace assembly of the invention.
Figure 14:
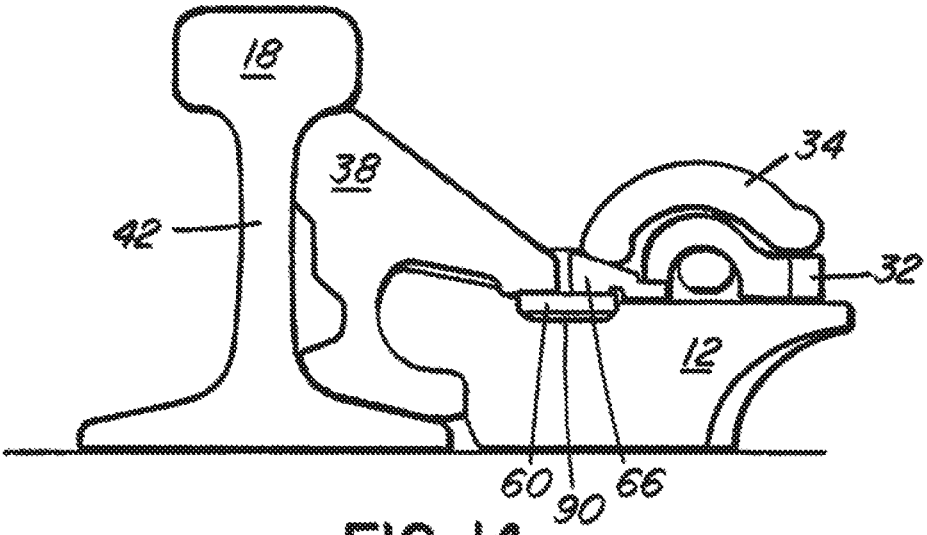
FIG. 14 is a side view of the rail brace assembly of FIG. 13.
Figure 19:
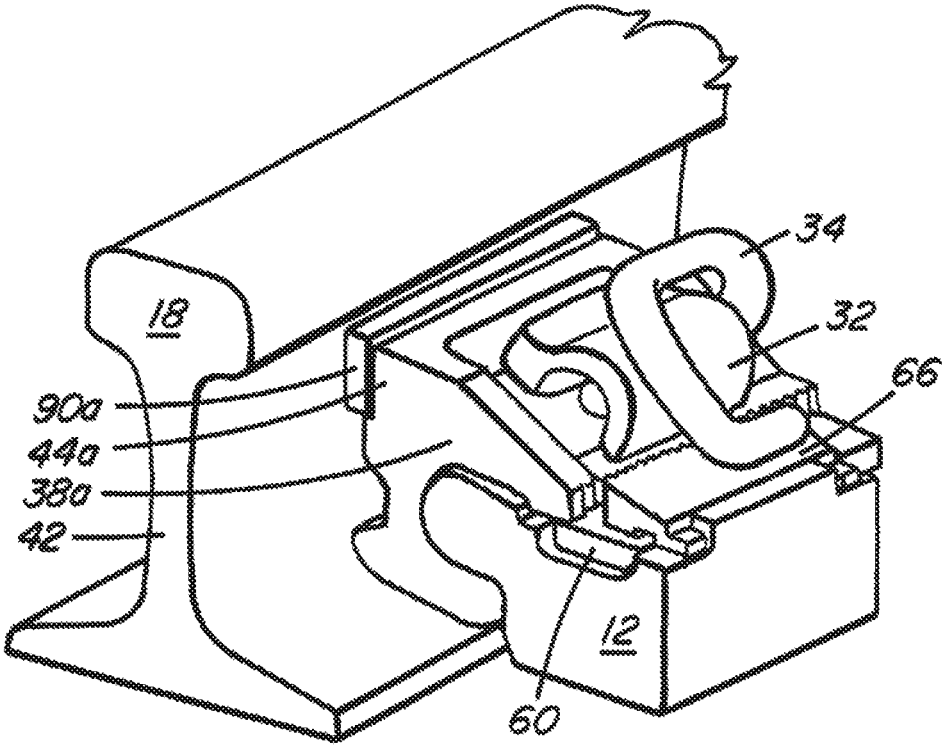
FIG. 19 is a perspective view of a sixth embodiment of the rail brace assembly of the invention.
Figure 20:
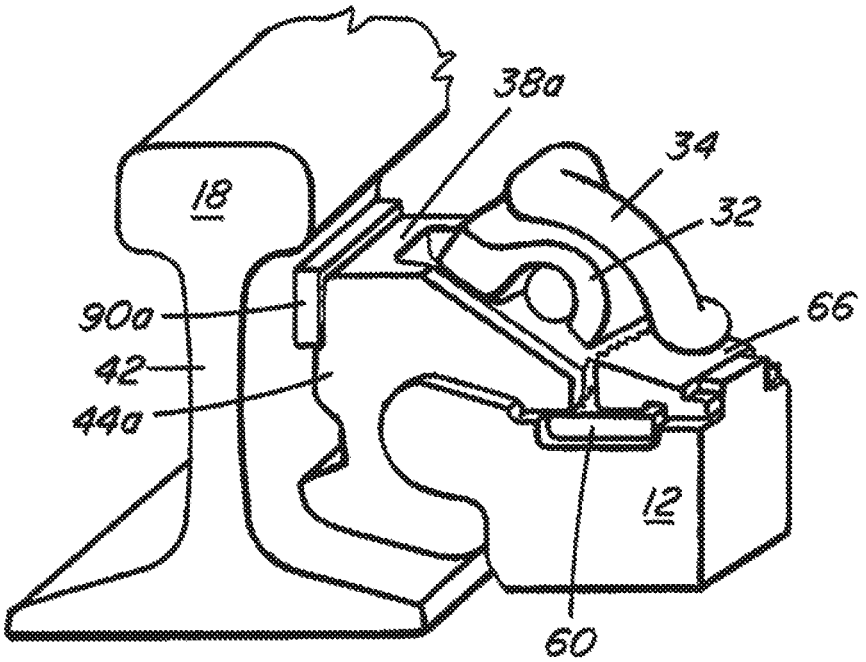
FIG. 20 is a side view of the rail brace assembly of FIG. 19.

There has been an interest in the industry in adding resilience to stock rails to better manage lateral loads applied by wheels. In a third embodiment of the invention, best shown in FIGS. 13 and 14, a resilient element 90 has been added in order to cushion the assembly. The resilient element 90 may be made of a suitable material; for example, a conventional material such as a steel spring may be used, or an engineered polymer such as polyurethane or rubber. The resilient element 90 is shown as a pad, but could be fashioned as a compression coil spring, a leaf spring, a torsional spring or a polymer or rubber compression element, as well as any other suitable configuration and material. In the brace assembly of FIGS. 13 and 14, the resilient element 90 is illustrated as being placed below the wedge 60 and the base block 12. It may be a separate or integral part of the wedge 60. It will be understood that the exact location of a resilient element 90 may vary. In a further embodiment of the invention, best shown in FIGS. 19 and 20, the top portion 44*a* of the brace 38*a* can be articulated to the body of the brace 38*a* and a resilience established between the two components by fitting resilient element 90*a* as a pad between the brace 38*a* and the web 42 of the rail 18. Again, the exact form of the resilient element 90*a* may also vary, as may the location.

Figure 15:
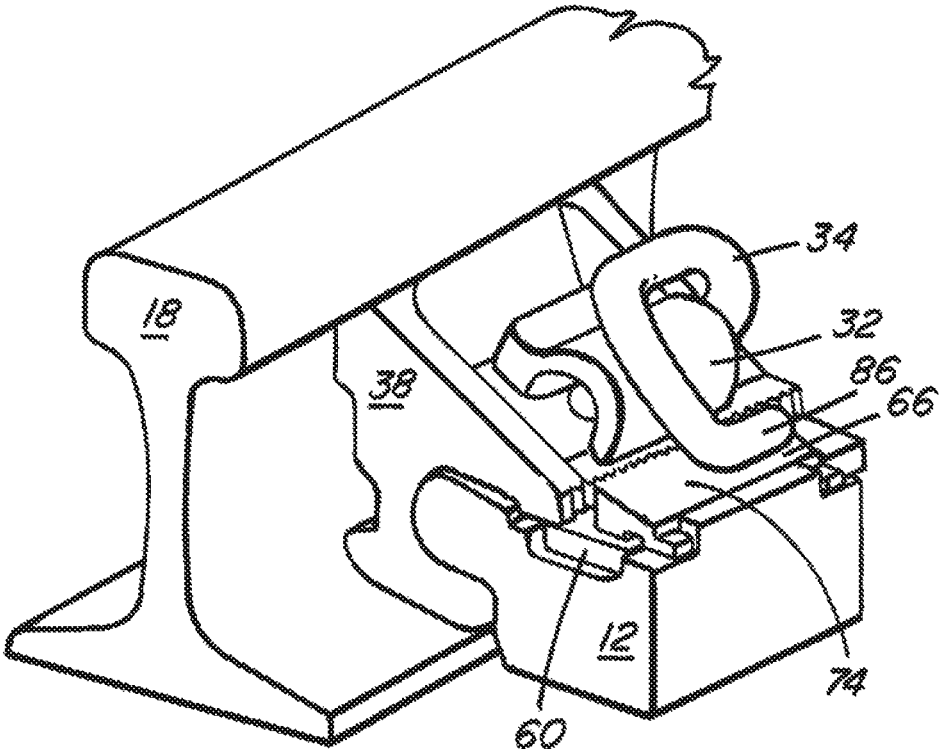
FIG. 15 is a perspective view of a fourth embodiment of the rail brace assembly of the invention.
Figure 16:
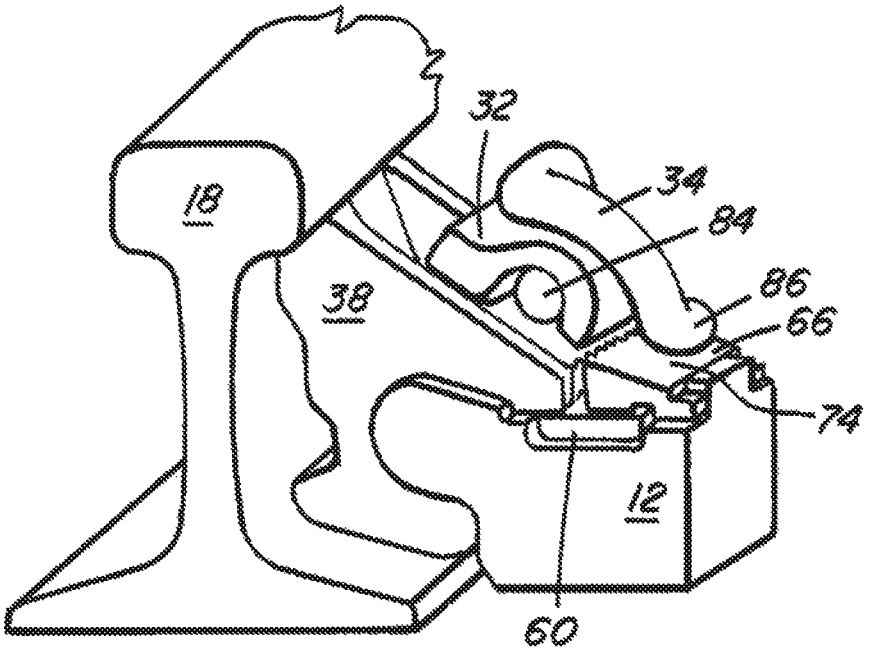
FIG. 16 is a side view of the rail brace assembly of FIG. 15.

In a further embodiment of the invention, best shown in FIGS. 15 and 16, the shoulder 32 may be attached to the body of the brace 38, rather than to the base block 12. The clip 34 is still positioned for the toe 86 to exert force on the exposed top surface 74 of the locking washer 66, and the overall forces are therefore identical to those in the first embodiment. This may provide a more compact, lightweight and/or cost-effective arrangement than having the shoulder 32 on the top of the base block 12, as the length of the base block can be significantly shortened.

Figure 17:
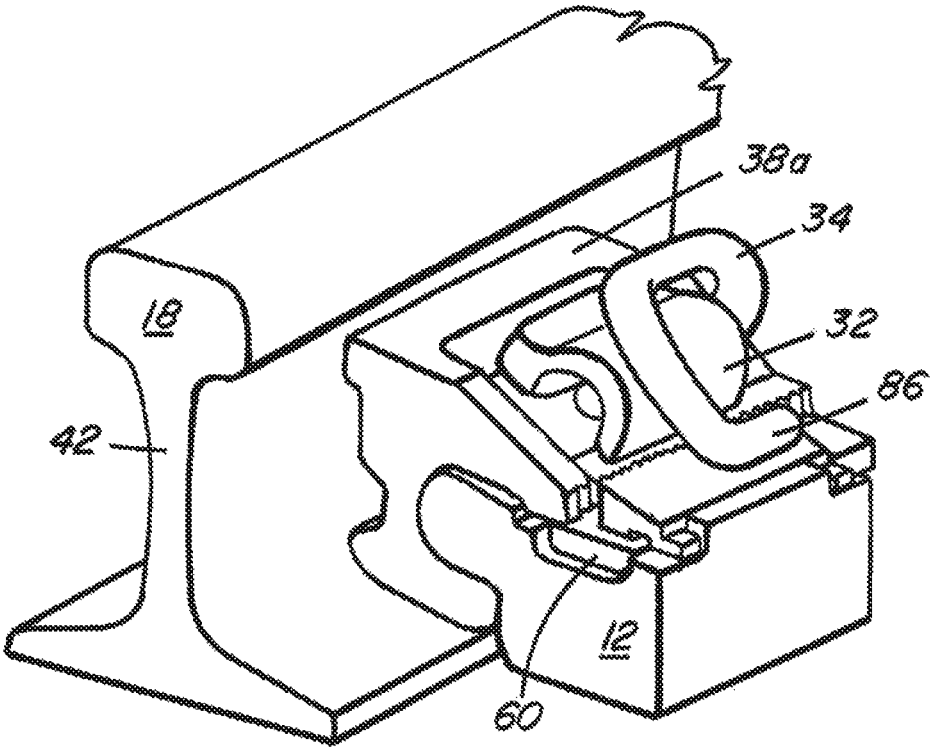
FIG. 17 is a perspective view of a fifth embodiment of the rail brace assembly of the invention.
Figure 18:
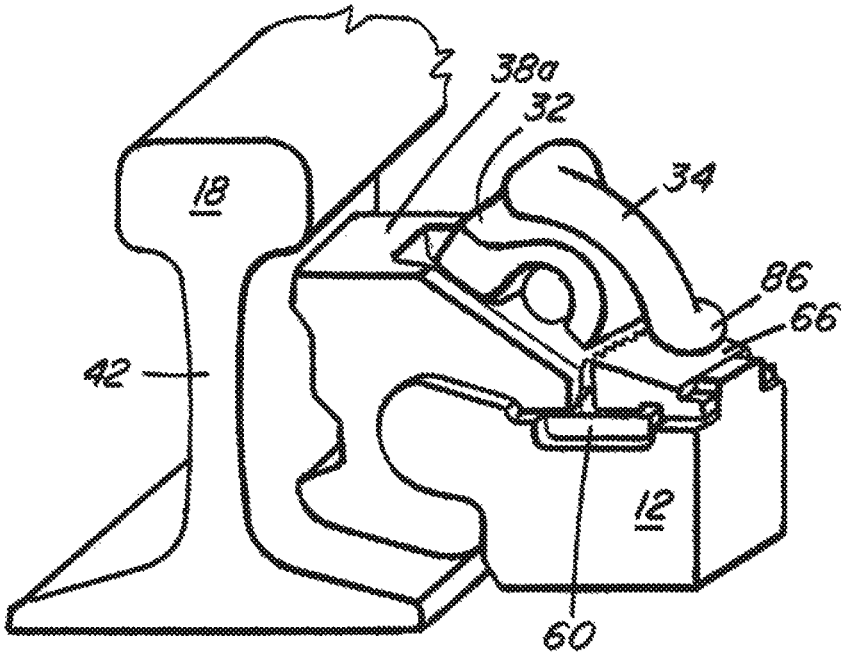
FIG. 18 is a side view of the rail brace assembly of FIG. 17.

A universal embodiment of the rail brace assembly in which the shoulder 32 is attached to the body of the brace 38*a* is shown in FIGS. 17 and 18.

Figure 21:
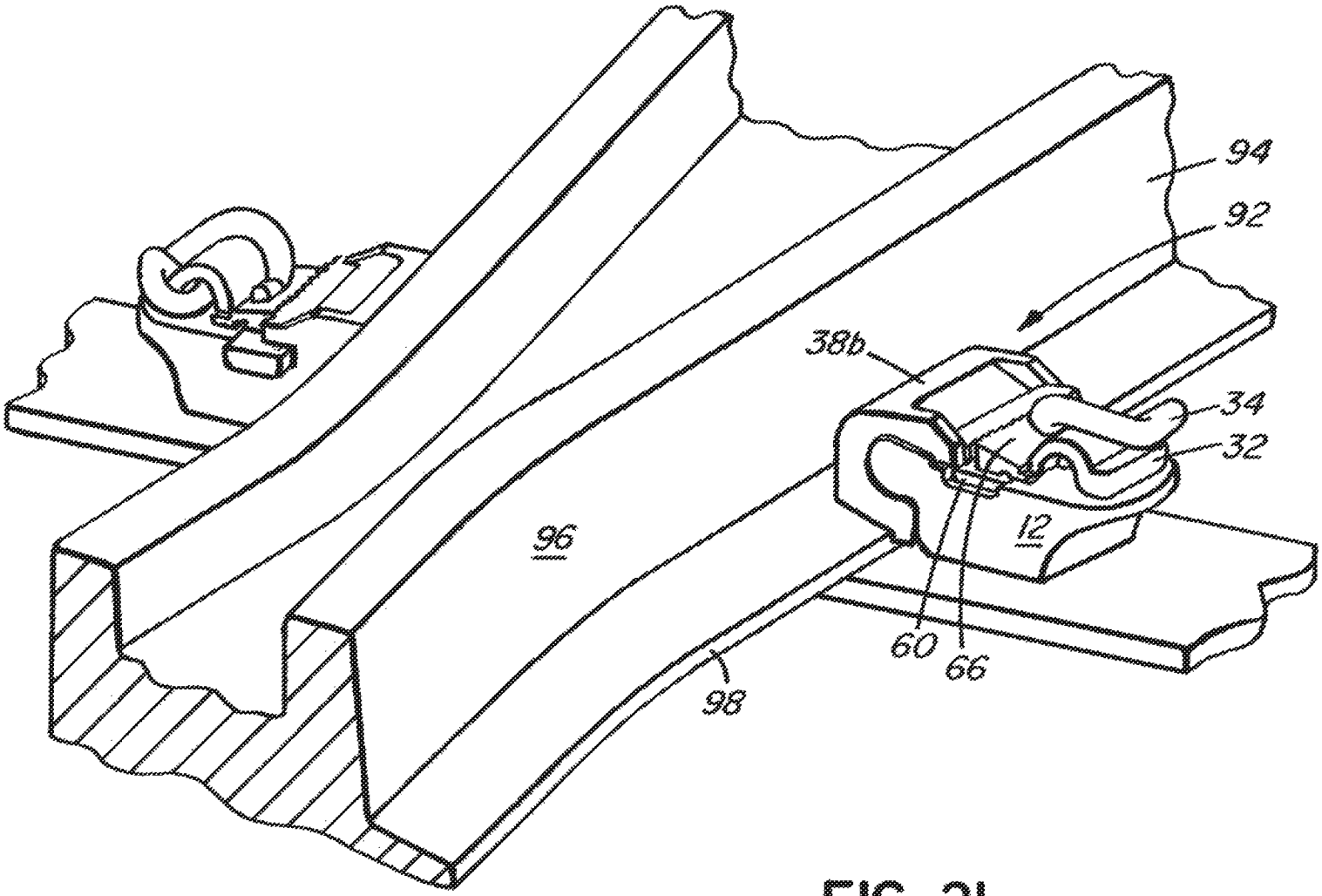
FIG. 21 is a perspective view of a seventh embodiment of the rail brace assembly of the invention, in use as a frog base clamp.
Figure 22:
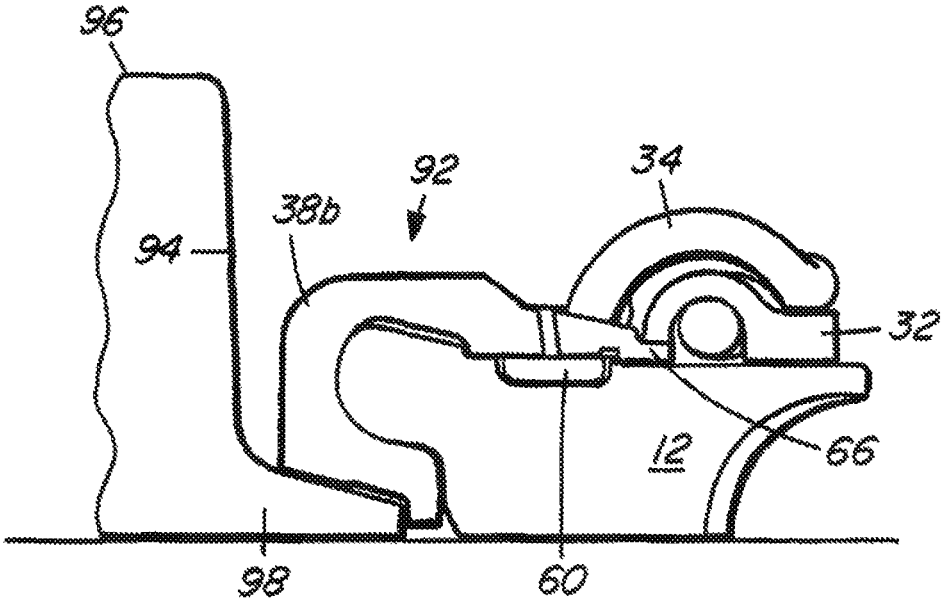
FIG. 22 is a sectional view of the frog base clamp of FIG. 21.

In a further application, a version of the brace could be employed as a frog base clamp 92. This device is typically used to adjust gauge in the frog area, compensate for irregular frog base footprints, and/or clamp a frog firmly to a baseplate. As best shown in FIGS. 21 and 22, the clamp 92 may utilize the same wedge/rotating brace design as the rail brace assembly but the brace 38*b* need not necessarily contact sidewall 94 of the frog 96. Otherwise the parts of the brace 38*b* are the same as in previous embodiments, as are the other parts of the assembly, including the base block 12 and wedge 60. Shoulder 32 and an elastic fastener, such as spring clip 34, may be provided along with locking washer 66, but as with the other embodiments, it will be understood that these components are not strictly necessary for the brace assembly to retain the frog base 98.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

What is claimed is:

1. An assembly to brace a rail, comprising:

a brace positionable on a base of said rail, said brace having a nose portion extending away from said rail;

a base block having a bottom surface and an opposed top surface, separated by a front side surface facing said rail, and an opposed rear side surface, said front side surface of said base block being interlockable with said brace and a portion of said top surface being located under said nose portion; and a wedge insertable in a channel in said top surface of said base block and at least partially below said nose portion of said brace such that said wedge applies an upward force on said nose portion of said brace and a resultant downward force on said rail base.

2. The rail brace assembly of claim 1 wherein said wedge tapers through its thickness, along its length.

3. The rail brace assembly of claim 1, further comprising a shoulder on said base block to accommodate an elastic fastener.

4. The rail brace assembly of claim 3 further comprising a locking washer placeable over a portion of said wedge to be retained by said fastener.

5. The rail brace assembly of claim 4 wherein said washer further comprises a pair of legs that extend beside said shoulder.

6. The rail brace assembly of claim 1, further comprising:

a groove in said brace; and a tongue on said front side surface of said base block;

wherein meshing of said groove and said tongue causes said base block and said brace to interlock.

7. The rail brace assembly of claim 1 wherein said brace does not contact the head of said rail.

8. The rail brace assembly of claim 1 further comprising a resilient element.

9. The rail brace assembly of claim 8 wherein said resilient element is between said brace and said rail.

10. The rail brace assembly of claim 8 wherein said resilient element is between said wedge and said brace.

11. The rail brace assembly of claim 8 wherein said resilient element is between said wedge and said base block.

12. The rail brace assembly of claim 1 wherein a top portion of said brace is articulated.

13. The rail brace assembly of claim 12 further comprising a resilient element between said top portion of said brace and said rail.

14. The rail brace assembly of claim 1 further comprising a shoulder on said brace to accommodate an elastic fastener.

15. The rail brace assembly of claim 14 further comprising a locking washer placeable over a portion of said wedge to be retained by said fastener.

16. The assembly of claim 1, used to brace a base of a frog, wherein said brace contacts only said base of said frog.

17. A method of installing an assembly to brace a rail comprising the steps of:

placing a base block a predetermined distance from said rail, said base block having a bottom surface and an opposed top surface, separated by a front side surface facing said rail, and an opposed rear side surface;

placing a brace on a base of said rail and between said rail and said base block such that said brace interlocks with said front side surface of said base block and a nose portion of said brace extends above said top surface of said base block;

inserting a wedge into a channel provided in said top surface of said base block until at least a portion of said wedge fits snugly under said nose portion of said brace such that said wedge applies an upward force on an underside of said nose portion and a resultant downward force on said rail base.

18. The method of claim 17 wherein said wedge tapers through its thickness, along its length.

19. The method of claim 17 further comprising the step of installing a fastener in a shoulder on said base block, wherein said fastener bears on a top surface of said wedge.

20. The method of claim 17 further comprising the step of providing a locking washer on top of said wedge.

21. The method of claim 20 wherein at least one of said locking washer, said wedge and said nose portion comprises a serrated surface.

22. The method of claim 20 further comprising the step of installing a fastener in a shoulder on said base block, wherein said fastener bears on a top surface of said locking washer.

23. The method of claim 17 further comprising the step of providing a resilient element between said brace and said rail.

24. The method of claim 17 further comprising the step of providing a resilient element between said wedge and said brace.

25. The method of claim 17 further comprising the step of providing a resilient element between said wedge and said base block.

26. The method of claim 17 wherein said assembly is used to brace a base of a frog and said brace contacts only said base of said frog.

* * * * *